United States Patent [19]

Brouillette

[11] Patent Number: 5,075,516

[45] Date of Patent: Dec. 24, 1991

[54] MINIATURE SINGLE IN-LINE PACKAGE ELECTRICAL SWITCH

[75] Inventor: Peter F. Brouillette, Manchester, N.H.

[73] Assignee: Augat Inc., Attleboro, Mass.

[21] Appl. No.: 530,827

[22] Filed: May 30, 1990

[51] Int. Cl.[5] ..... H01H 5/18

[52] U.S. Cl. ..... 200/5 R; 200/6 R; 200/408

[58] Field of Search ..... 200/5 R, 6 R, 6 B, 6 BA, 200/6 BB, 6 C, 408, 409, 451, 558, 562, 568, 553, 569, 302.3

[56] References Cited

U.S. PATENT DOCUMENTS

| | | | |
|---|---|---|---|
| 3,291,951 | 12/1966 | Kalous | 200/569 |
| 3,900,709 | 8/1975 | Sheesley et al. | 200/5 R |
| 3,944,760 | 3/1976 | Zdanys et al. | 200/6 BB |
| 3,988,555 | 10/1976 | Hooper, Jr. | 200/569 |
| 4,117,280 | 9/1978 | Feaster | 200/6 B |
| 4,119,823 | 10/1978 | Matsueda et al. | 200/302.3 |
| 4,399,336 | 8/1983 | Greve | 200/11 R |
| 4,412,108 | 10/1983 | McCarty | 200/5 R |
| 4,496,802 | 1/1985 | Rose et al. | 200/5 R |
| 4,599,497 | 7/1986 | Rose et al. | 200/5 R |
| 4,612,422 | 9/1986 | Rose et al. | 200/5 R |

*Primary Examiner*—J. R. Scott

*Attorney, Agent, or Firm*—Weingarten, Schurgin, Gagnebin & Hayes

[57] ABSTRACT

A single in-line package switch for individually switching a number of terminals to establish separate conductive paths with a common terminal. The switch comprises an insulating housing with a number of terminal pins exceeding the number of switching poles by one. The insulating housing has an internal cavity corresponding to each terminal switch and recesses in certain of the cavities for receiving rotary actuators. A cover and base clamp a common strip portion of a contact finger structure and bias cantilevered contact fingers into engagement with internal contact end sections of the terminals. One of the contact fingers permanently contacts one terminal connected to a reference potential, thereby establishing a fixed electrical path between the common strip portion and the reference potential. Each actuator includes a planar portion for engaging a free end section of the contact fingers for producing the switching action. The actuators and insulating base have coacting means that provide detent and snap action.

14 Claims, 4 Drawing Sheets

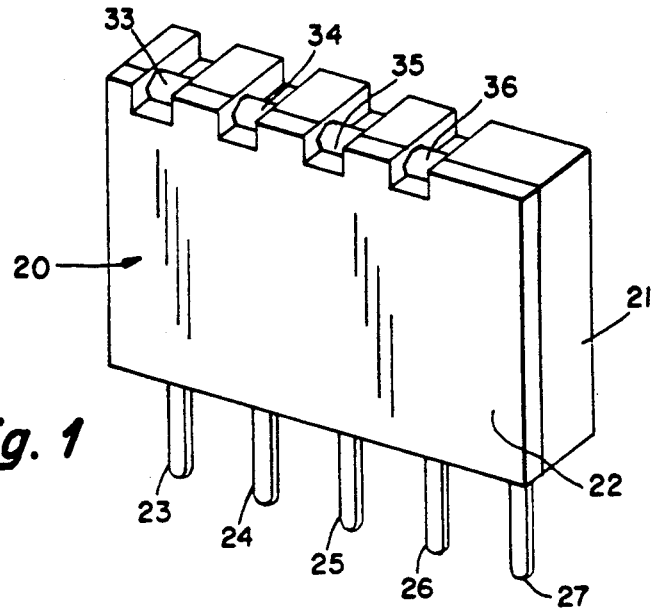
Fig. 1
Fig. 2
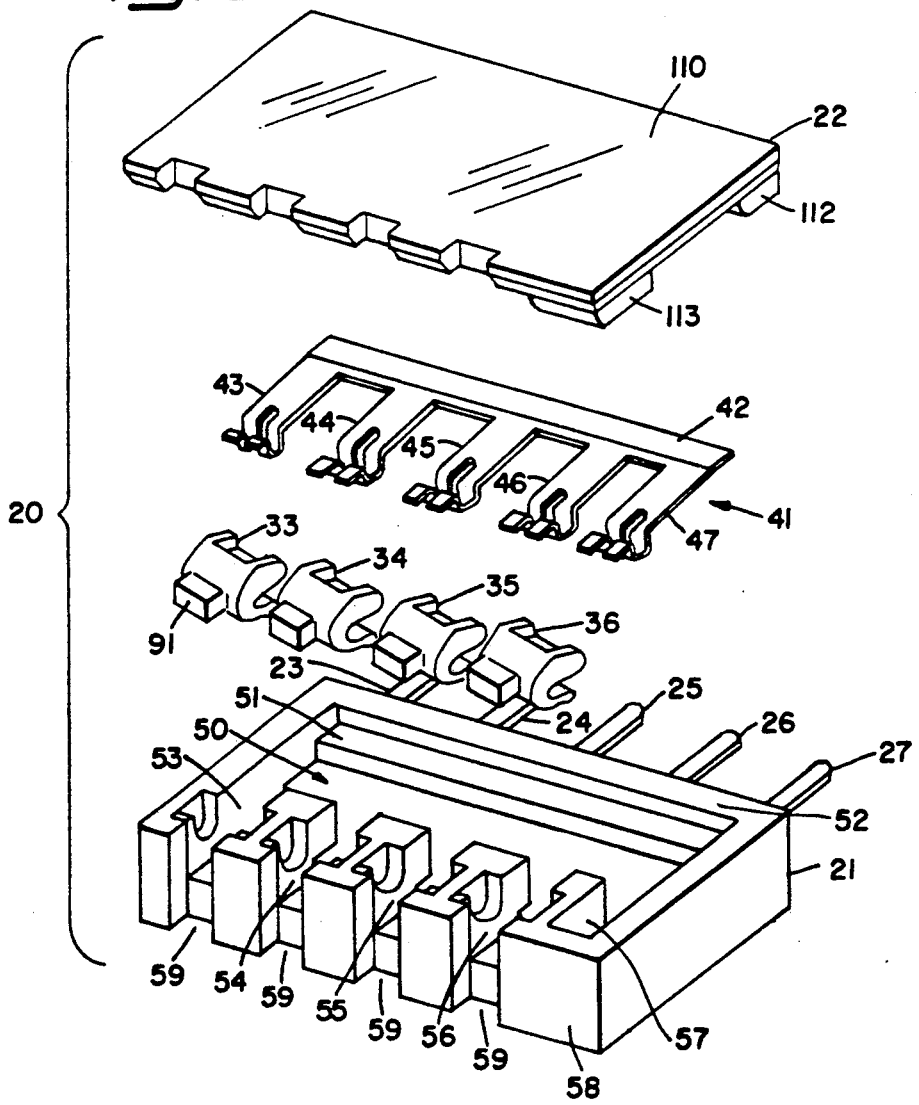

Fig. 3
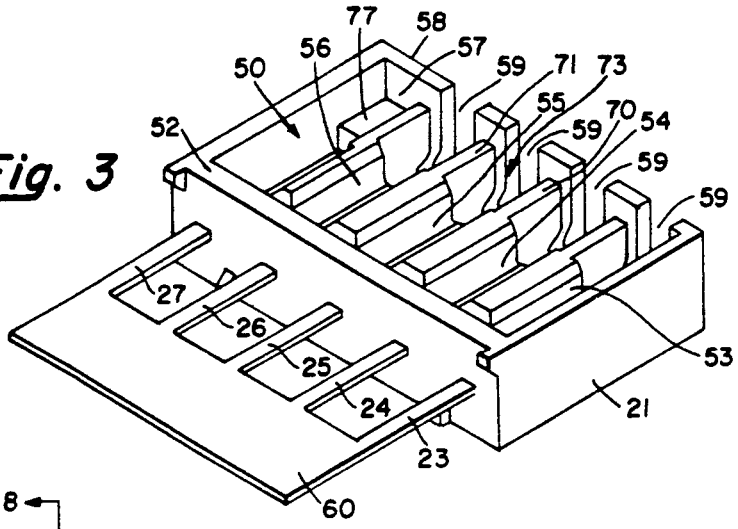
Fig. 4
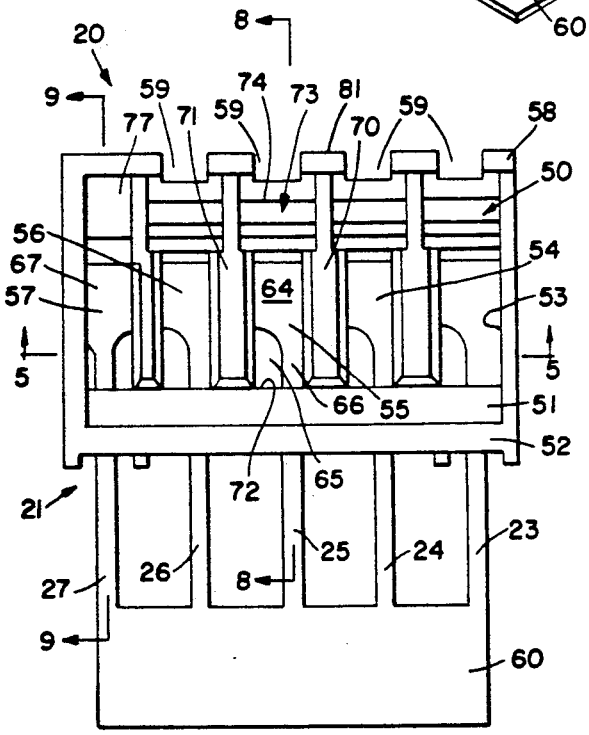
Fig. 5
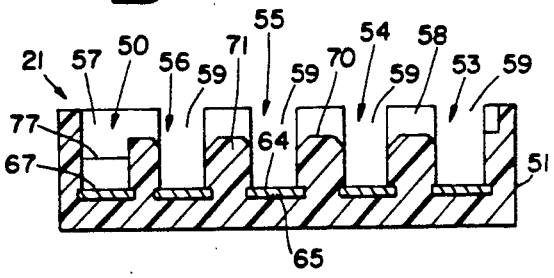
Fig. 6
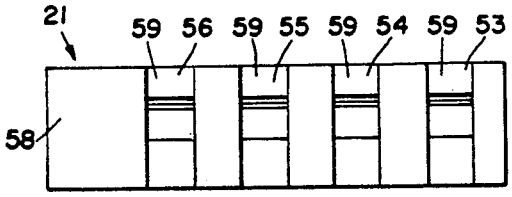
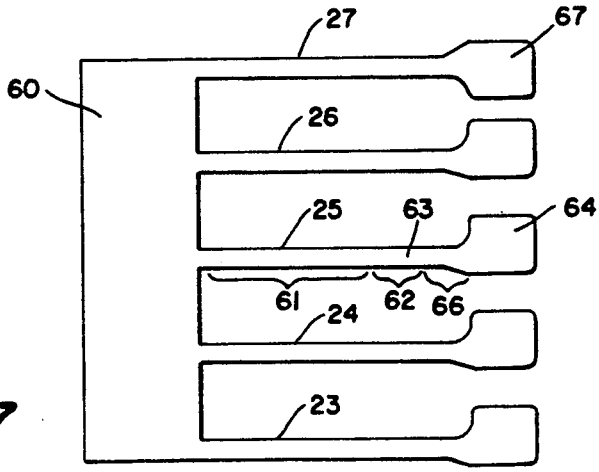
Fig. 7

Fig. 8
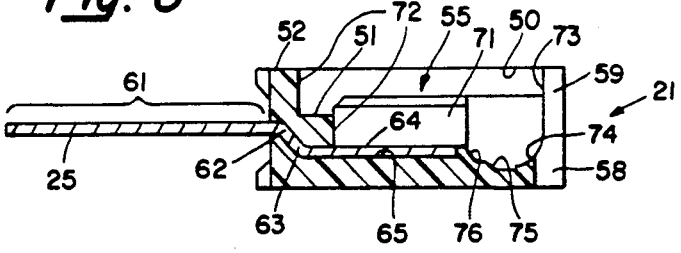
Fig. 9
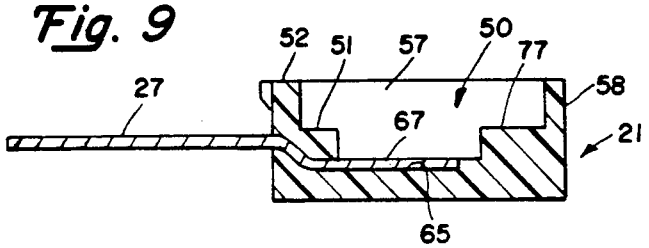
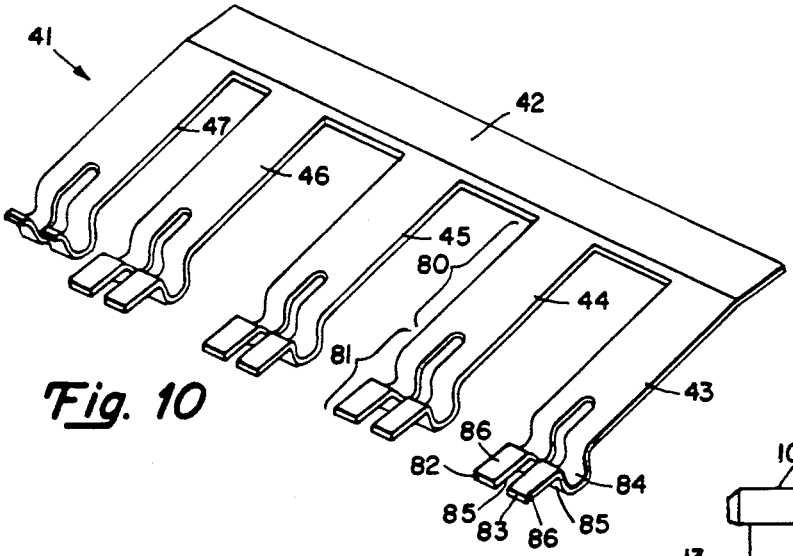
Fig. 10
Fig. 11
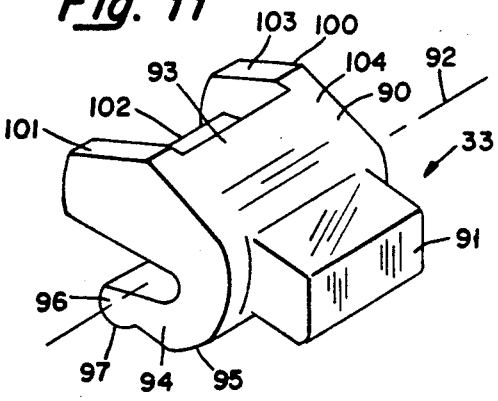
Fig. 12
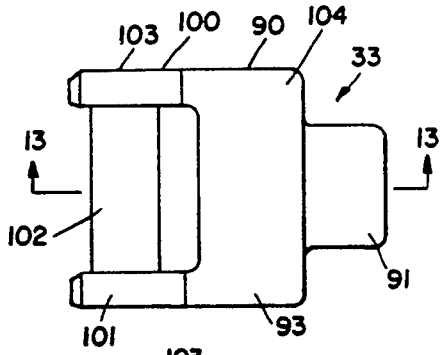
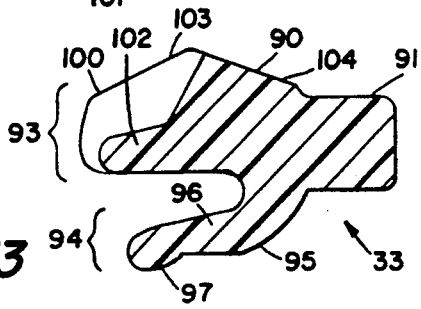
Fig. 13

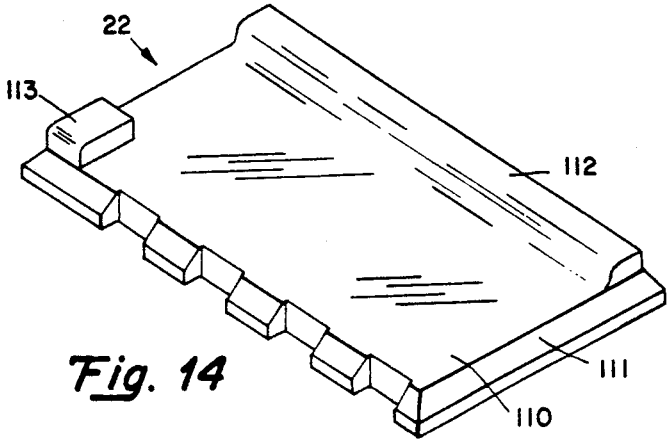
Fig. 14
Fig. 16
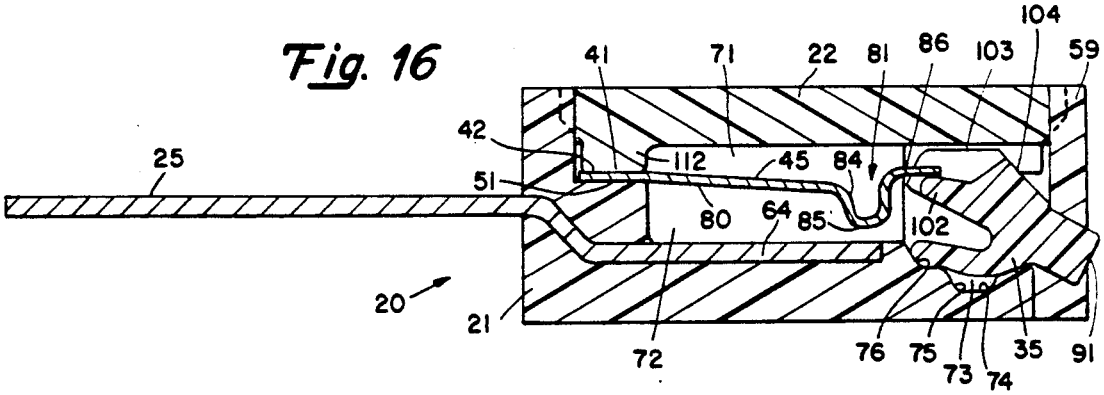
Fig. 15
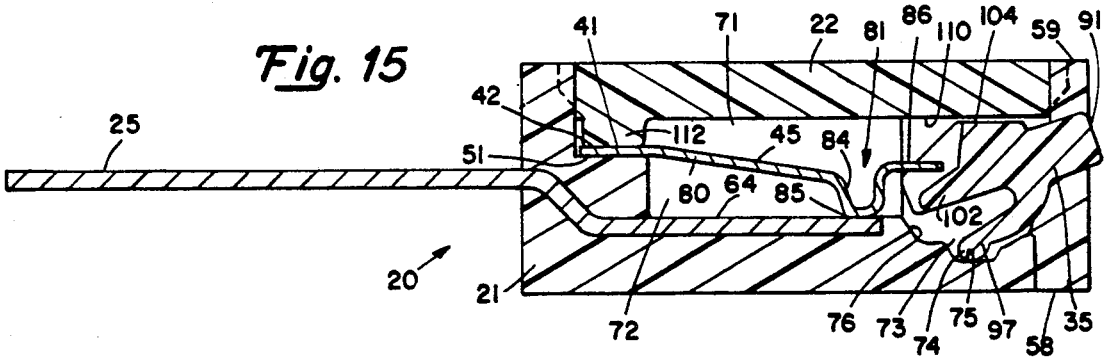

MINIATURE SINGLE IN-LINE PACKAGE ELECTRICAL SWITCH

BACKGROUND OF THE INVENTION

1. Field of the Invention

This invention generally relates to electrical switching devices and more particularly to switching devices of the single in-line package type.

2. Description of Related Art

Single in-line package (SIP) switches have many applications, particularly in electronic circuitry used in digital data processing systems and like products. For example, such products often include groups of termination resistors connected to various signal lines. Each termination resistor connects between a signal line and a fixed potential (typically +5 VDC). A switch then couples the common connection of the termination resistor and signal line to a ground potential. When the switch is open, the signal line floats at the positive potential. When the switch closes, the signal line is clamped at ground potential.

Different switching alternatives exist for such applications especially when the signal lines are logically related. As an example, a group of four signal lines and switches can collectively set a baud rate for data transmission. In accordance with one alternative a 4×4 matrix of eyelets could be formed on a printed circuit board. Conduct runs could connect a first row to a positive reference potential; the fourth row, to ground. The eyelets in each column of the second and third rows would connect to a corresponding signal line and to each other. The termination resistors would be inserted between the corresponding eyelets in the first and second rows. Individual switching devices then could be inserted between the corresponding eyelets in the third and fourth rows. Thus, this arrangement allows the state of each signal line to be controlled individually.

As another alternative, a four-pole dual in-line package (DIP) switch could be substituted for the individual switches. This simplifies manufacturing assembly because one component is substituted for four individual switches. However, a DIP switch requires approximately the same area on the printed circuit board as four individual switches. Secondly, the individual poles in a DIP switch are independent switches that incorporate separate, isolated switch mechanisms. This increases the cost of implementing the switching function in many applications.

SIP switches can provide more switch contacts than a DIP switch in a given printed circuit board area. Prior art SIP switches often include an insulating base and a cavity for housing a self-contained switching mechanism including two spaced contacts, a bridging contact and a detent mechanism for permitting an individual to "feel" the switch move between the open and closed positions.

U.S. Pat. No. 4,399,336 describes one such miniature rotary SIP switch for mounting on a printed circuit board. In this SIP switch, each pole has oppositely disposed contact leaf portions extending through a housing with an exterior terminal section and interior cantilevered switching section. A rotor disposed between contact portions of the interior switching sections can rotate between first and second positions. In a first position, a diametrically extending contact pin engages the contact portions of both leaf springs. The contact portions have dimples that coact with the contact pin to provide a detent when the switch turns on. In the second position the rotor interposes an insulating path between the contact leaves. Moreover, molded detent protrusions engage the dimples to provide a detent in this position. Each pole is self contained; the poles and terminal pairs for each pole are in a single line. As this switch includes independent switching structures at each pole position, it can be overly expensive for many applications. Although such switches improve switch density on the printed circuit board, even greater densities are necessary and desirable, especially as other component densities increase.

SUMMARY

Therefore it is an object of this invention to provide a switching device of the single in-line package type that is particularly adapted for electronics applications.

Another object of this invention is to provide a switching device of the single in-line package type with improved reliability achieved through a reduction in a number of components.

Still another object of this invention is to provide a switching device of the single in-line package type in which manufacturing is simplified by reducing the number of components.

Still another object of this invention is to provide a switching device of the single in-line package type that minimizes the area required for switching functions on printed circuit boards.

In accordance with this invention, a single in-line package switch for electrical circuits includes an insulating housing with elongated spaced, parallel switching cavities that have first and second end sections and intermediate support portions A terminal for each cavity has a contact end section on a corresponding support portion and a terminal section external to the insulating housing. All the terminal means lie in a single plane. A unitary contact means has spaced parallel contact fingers cantilevered from a common strip portion that is transverse to the first end portions of the cavities. Each contact finger is aligned with one of the cavities and includes a free end section for abutting the contact end section of a terminal in the corresponding cavity. An actuator is located in certain of the cavities for displacing the contact finger from the terminal contact end section thereby to break an electrical path. One contact finger permanently contacts one terminal thereby to establish a fixed electrical path between the common strip and a reference potential on a printed circuit board.

BRIEF DESCRIPTION OF THE DRAWINGS

This invention is pointed out with particularity in the appended claims. The various objects, advantages and novel features of this invention will be more fully apparent from a reading of the following detailed description in conjunction with the accompanying drawings in which like reference numerals refer to like parts, and in which:

FIG. 1 is a perspective view of a single in-line package switch constructed in accordance with this invention;

FIG. 2 is an exploded view in perspective of a single in-line package switch constructed in accordance with this invention;

FIG. 3 is a perspective view of an insulating base portion and terminals taken in a view differing from that shown in FIG. 2;

FIG. 4 is a top plan view of the insulating base shown in FIG. 3.

FIG. 5 is a section view taken along lines 5—5 in FIG. 4;

FIG. 6 is an end view of the insulating base shown in FIG. 3;

FIG. 7 is a plan view of a terminal strip used in the insulating base shown in FIG. 3;

FIG. 8 is section view taken along lines 8—8 in FIG. 4;

FIG. 9 is a section view taken along lines 9—9 in FIG. 4;

FIG. 10 is a perspective view of a contact structure shown in FIG. 2;

FIG. 11 is a perspective view of an actuator shown in FIG. 2;

FIG. 12 is a top plan view of the actuator shown in FIG. 11;

FIG. 13 is a section view taken along lines 13—13 in FIG. 12;

FIG. 14 is a perspective view of a top cover shown in FIG. 2;

FIG. 15 is a cross-sectional view of a switch taken along a line corresponding to lines 8—8 in FIG. 4 with the contact closed; and FIG. 16 is a cross-sectional view corresponding to that in FIG. 15 with the contact open.

DESCRIPTION OF ILLUSTRATIVE EMBODIMENT

FIG. 1 discloses a four-pole single in-line package (SIP) switch 20 constructed in accordance with this invention. A SIP switch that incorporates four poles is particularly advantageous when binary-coded-decimal switching functions are required. It will be apparent that any number of pole positions can be included in such a switch.

This SIP switch 20 has an insulating housing comprising an insulating base assembly 21 and a cover 22. Terminals 23, 24, 25, and 26 extend from an edge of the SIP switch 20 and constitute switched terminals. Another terminal 27 constitutes a common terminal that normally connects to a reference potential, such as a ground. Actuators 33, 34, 35 and 36 individually operate internal switching elements for each of the switch terminals 23 through 26, respectively. As becomes more apparent later, the SIP switch 20 establishes a conductive path between the common terminal 27 and one of the switched terminals 23 through 26 when a corresponding one of the actuators 33 through 36 is in a "on" position and breaks the path when the corresponding actuator is in an "off" position. Moreover, the terminals 23 through 26 switch independently of each other.

In accordance with the objectives of this invention, terminals 23 through 27 are at a standard 0.100 inch on-center spacing. A four-pole switch therefore occupies an area on a printed circuit board of approximately $0.5 \times 0.125$ inches, thus providing four switching function in 1/16 square each (i.e, a density of 64 switching functions per square inch).

FIG. 2 is an exploded view of the four-pole SIP switch 20 that discloses, in perspective, the few components that are necessary to construct a switch in accordance with this invention. The insulating base unit 21 is integrally molded about terminals 23 through 27 and supports a cover 22, the actuators 33 through 36 and an integral unitary contact structure 41. The contact structure 41 includes a common strip section 42 and a plurality of spaced contact fingers 43, 44, 45, 46, and 47 cantilevered from the common section 42 to engage terminals 23 through 27 respectively. As described later, the actuators 33 through 36 individually move the contact fingers 43 through 46 between open and closed positions. The contact finger 47 constantly engages the terminal 27 for providing permanent electrical path between the terminal 27 and the common strip section 42 and each of the fingers 43 through 46.

The contact structure 41 is positioned in a large open cavity 50 in the insulating base 21. As described later, the cavity contains an upper platform 51 adjacent an end wall 52. A series of elongated cavities 53 through 57 extend from the platform portion 51 toward an opposite wall 58. The cavities 53 through 58 receive the contact fingers 43 through 48 respectively. In addition recesses 59 in the wall 58 aligned with the cavities 53 through 56 provide access to the actuators 33 through 36.

Now discussing each of the components in detail, FIGS. 3 through 9 depict the structure of the insulating base 21 and terminals 23 through 27. Referring particularly to FIG. 3, the terminals 23 through 27 pass through the end wall 52 of the insulating base 21. As shown in FIG. 7, the terminal structure can be stamped from a sheet of conductive material and the individual terminals 23 through 27 cantilever from a common flag portion 60. Referring particularly to FIGS. 7 and 8, the terminal 25 is external to the base wall 52. This represents an external terminal section length designated by reference numeral 61. A contiguous section 62 is imbedded in the insulating base 21 during an insulating base molding operation. The contiguous section 62 has an offset 63 that allows a terminal contact end section 64 to rest on a support surface 65 in the insulating base 21.

As apparent from FIG. 7, the terminal contact end section 64 is wider than the remainder of the terminal 25. A transition section 66 lies intermediate the sections 62 and 64. The terminals 23, 24 and 26 have the same configuration. The terminal 27 has a similar configuration, except that its terminal contact end section 67 is faced in a reverse direction to that of the terminal contact section 64.

During a molding operation, the terminal strip as shown in FIG. 7 becomes an integral part of the insulating base 21.

Referring specifically to FIGS. 3 through 6, the insulating base 21 contains all the terminals with the terminals 23 through 27 extending externally to the wall 52. Referring to FIGS. 3 through 8, spaced parallel wall structures 70 and 71 define the elongated switching cavity 55. The wall structure 70 is common to the cavity 54 and the wall structure 71 is common to the cavity 56. Similar wall structures define the other cavities. Each cavity, like the cavity 55, has a first end section 72 adjacent the platform 51 and a second end section 73 adjacent the wall 58. The intermediate support surface 65 extends between the end sections 72 and 73.

Referring particularly to FIGS. 4 and 8, the cavity 55 additionally includes a radiused seat portion 74 with first and second spaced detent depressions 75 and 76. The seat 74 receives a corresponding actuator and enables the actuator to rotate between the "on" and "off" positions. Thus, as particularly shown in FIG. 8, the insulating housing 21 provides a unitary structure in which the terminal 25 and the other terminals 23, 24, 26 and 27 exit the housing 21 at the midline of the housing structure. The terminals are integral structures that have contact end sections, such as contact pads 64 and 67, fully supported on an intermediate support surface 65. The insulating base has individual switching cavities 53 through 56 with the cavity 55 by way of example, having side walls including the side walls 70 and 71 as shown in FIG. 8. The side walls extend between a first end section 72 of the cavity adjacent the platform 51 and a second end section 73 adjacent the exterior wall 58. A seat structure 74 is located at the second end section 73.

The switching cavity 57 shown in FIGS. 4 and 9 also has a first end section and an intermediate support surface 65 for the contact end section 67. The cavity 57, however, does not have a seat formed adjacent the wall 58. Rather there is a step structure 77 that engages the cover 22 as described later.

Once the structure shown in FIG. 3 is complete, it receives the contact structure 41 shown in FIGS. 2 and 10. The contact structure 41 can be stamped from a conductive spring material such as beryllium copper. The common strip section 42 lies on the platform 51 adjacent the first end section. In this position the common strip section 42 traverses each of the cavities 53 through 57 at their respective first end sections. Referring specifically to FIG. 10, each of the contact fingers 43 through 46 has an identical structure, so only the contact finger 43 is described in detail. Specifically the finger 43 includes a solid, planar cantilevered arm 80 with a free end section 81. The finger 43 is coplanar with the other fingers and that plane normally is offset from the plane of the common strip section 42.

The free end section 81 is bifurcated. Each of the bifurcations 82 and 83 has a depending radiused portion 84 thereby to provide a radiused contact surface 85 that engages the corresponding contact end section of a terminal. Each of the contact fingers 43 through 46 additionally includes an extension 86 on the bifurcations 82 and 83 beyond the radiused contact portion 85 for engagement by the actuators.

As will be apparent from FIG. 10, the contact 47 has a similar structure. That is, it also has a cantilevered arm 80 and a free end section 81. The free end section 81 is bifurcated, but the contact finger 47 terminates without an extension such as extensions 86 found on the contact fingers 43 through 46.

Referring again to FIG. 2, after inserting the contact structure 41 with the common strip section 42 lying on the platform 51, the actuators 33 through 36 are installed. FIGS. 11, 12 and 13 disclose the structure of a typical actuator 33. The actuator 33 is molded from a plastic material and has a body portion 90 and a radially protruding handle portion 91. An axis 92 shown in FIG. 11 divides the actuator 33 into conjoined upper and lower body portions 93 and 94. The lower body portion 94 has, in cross-section, a surface 95 on an arm 96 that conforms generally to the shape of the lower portion of the seat portion 74 in a switching cavity as shown in FIG. 8.

The upper portion 93 contains end sections 100 and 101 that support a radial planar extension 102. The planar extension 102 engages the free-end extensions 86 of the contact fingers. The upper surface of the end sections 100 and 101 are formed as two angled planar surfaces 103 and 104. These surfaces provide a "snap" action as described later.

The actuators 33 through 36 are installed in the housing shown in FIG. 2 with their respective planar extensions 102 lying below the extensions 86 on the contact fingers. Then the cover 21 can be affixed to the insulating base 20 by ultrasonic welding or other techniques. As shown in detail in FIG. 14, the cover 22 has a generally planar section 110 and chamfered edge surfaces such as edge surfaces 111 for engaging the interior side walls of the insulating base at the upper portions of the cavity 50. A beam 112 traverses the back portion of the cover and a block 113 is formed at the corner of the cover 22 that will position over the cavity 57 at the wall 58 and engage the block 77.

When the cover 22 is installed, the beam 112 engages the common strip portion 42 of the contact structure and depresses that structure forcing the radiused contact surfaces, such as contact surface 85 into contact with the contact end sections such as section 64 of the terminal 25. As shown in FIG. 15, in this position the planar extension 102 lies below the free end extension 86, and the detent extension 97 lies in the first detent depression 75. In addition the surface 104 on the actuator 35 lies parallel to the bottom surface 112 of the cover 22. The handle 91 of the actuator 35 extends through the corresponding recess formed in the end wall 58.

Referring to FIGS. 2, 9 and 10, the forces in the unitary contact structure 41 bias the radiused contact surface 85 on the contact finger 47 into engagement with the contact end section of terminal 27. The terminal 27 connects to the reference voltage and thus the terminal 27, switching arm 47, and the cavity 57 constitute a common terminal, cavity and contact finger. This contact finger is not displaced and establishes a permanent conductive path between the contact structure 41 and the common terminal 27. Referring to FIGS. 2 and 15, the forces in the unitary contact structure also produce a strong downward moment on the free end 81 of the contact finger 45 thereby to produce intimate contact with the pad 64 and complete the conductive path from the terminal 27 through the terminal 25 in the switching cavity 55. Similar forces act on the contact fingers in the other switching cavities.

If it is desired to open or break the circuit at the terminal 25, an individual depresses the handle 91. This forces the detent extension 97 from the detent depression 75 and toward and eventually into the detent depression 76. Simultaneously the extension 102 engages the free end extension 86 and displaces the contact surface 85 from the contact end section 64. This motion increases the downward pressure on the contact so the contact finger produces a restoring force acting on the arm 102. However, as the actuator 35 rotates, the surface 104 will move out of contact with the cover 22 and eventually a common line between the surfaces 104 and 103 reaches an over-center position, whereby the restoring force causes the actuator 45 to rotate and snap to the position shown in FIG. 16 thereby to provide a stable open circuit condition for the terminal 25. When an individual desires to close the switch the same over-center action occurs. This time, however, the contact finger acts on the arm 102 and snaps the actuator 35 back to the position shown in FIG. 15.

In summary a switch constructed in accordance with this invention provides a single in-line package type switch that is particularly adapted to electronic applications. The switch is highly reliable because there are few moving parts and those parts are not subjected to undo wear even in repeated use. Manufacturing is simplified because only a few parts are required, and those parts can be produced by straightforward manufacturing processes. Further a number of switching functions are incorporated into a multi-pole switch with a high density. In fact if switches are stacked at their maximum density, 64 switching functions can be incorporated per square inch of printed circuit board with one particular embodiment. Although this invention has been described in connection with a four-pole single in-line package switching device, it will be apparent that a switch can be constructed with any number of switching cavities. Further it will be apparent that any number of modifications can be made to the individual components or the interrelationship of the components while attaining some or all of the advantages of this invention. Therefore, it is the intent of the appended claims to cover all such variations and modifications as come within the true spirit and scope of this invention.

What is claimed as new and desired to be secured by Letters Patent of the United States is:

1. A single in-line package switch for electrical circuits comprising:

A. insulating housing means having first and second elongated cavities, each with a first end section, a second end section and an intermediate support portion, a seat portion being formed in at least one of said cavity second end sections, and a terminal for each said cavity, each said terminal having a contact end section disposed on a corresponding one of said support portions and a terminal section external to said insulating housing means for connection to an electrical circuit, B. unitary contact means having a common strip section transverse to said cavity first end sections and a plurality of spaced, parallel contact fingers cantilevered from said common strip section, each said contact finger being aligned with one of said cavities and including a free end section in contact with a terminal contact end section in said corresponding cavity thereby providing an electrical path between said common strip section and said corresponding terminal, and C. an actuator means being located in each said cavity seat portion for displacement between first and second positions and having contact finger engaging means for engaging said free end section of said corresponding contact finger, said contact engaging means, in the first and second positions of said actuator, permitting and breaking respectively said electrical path between said common strip section and said corresponding terminal.

2. A single in-line package switch as recited in claim 1 wherein a said cavity with a seat portion constitutes a switching cavity and the other said cavity constitutes a common cavity, a said contact finger in said switching cavity having an extension thereon at said free end thereof for engagement by said contact finger engaging means.

3. A single in-line package switch as recited in claim 2 wherein said unitary contact means comprises an electrical conductive spring material, each said contact finger means has a planar elongated body section between said common strip and free end sections and each said free end section is bifurcated, the bifurcations each having a radiused depending portion forming a contact surface for engaging said terminal contact end section.

4. A single in-line package switch as recited in claim 2 wherein each of said terminals lies in common plane, and each said actuator rotates about an axis parallel to the common plane and has a central body portion and axial end sections for riding in said seat means and supporting said body portion, said contact engaging means comprising a radial planar extension from said body portion between said axial end sections.

5. A single in-line package switch as recited in claim 4 wherein said insulating housing includes an insulating base and insulating cover, said insulating base having each said seat portion formed therein with first and second detent recesses, a said actuator having an upper portion including said radial planar extension and a conjoined lower portion, said upper portion having first and second angled surfaces for defining first and second positions of the actuator with said cover means and said lower portion having a detent extension and for engaging said first and second detent recesses at positions corresponding to the first and second actuator positions.

6. A single in-line package switch as recited in claim 1 wherein said insulating housing comprises an insulating base and cover, said insulating base having a platform coextensive with and transverse said first end sections of said cavities, and said cover has a depending beam coextensive with said platform, said beam and platform clamping said common strip section therebetween, said common strip section normally lying in a plane that is angularly displaced from a plane common to said contact fingers whereby said clamping action stresses said contact fingers and forces them into engagement with said terminal contact end sections.

7. A single in-line package switch as recited in claim 6 wherein each said seat portion has first and second detent recesses, a said actuator having an upper portion including said radial planar extension and a conjoined lower portion, said upper portion having first and second angled surfaces for defining first and second positions of the actuator with said cover means and said lower portion having a detent extension and for engaging said first and second detent recesses at positions corresponding to the first and second actuator positions.

8. A multiple pole, single in-line package, switch for electrical circuits comprising:

A. insulating housing means having a common cavity and a plurality of switching cavities corresponding to the number of poles, each said cavity being elongated and having a first end section, a second end section and an intermediate support portion, a seat portion being formed in at least one of said cavity second end sections, and a terminal for each said cavity, each said terminal having a contact end section disposed on a corresponding one of said support portions and a terminal section external to said insulating housing means for connection to an electrical circuit, B. unitary contact means having a common strip section transverse to said cavity first end sections and a plurality of spaced, parallel contact fingers cantilevered from said common strip section, each said contact finger being aligned with one of said cavities and including a free end section in contact with a terminal contact end section in said corresponding cavity thereby providing an electrical path between said common strip section and said corresponding terminal, and C. an actuator means being located in each said switching cavity seat portion for displacement between first and second positions and having contact finger engaging means for engaging said free end section of said corresponding contact finger, said contact engaging means, in the first and second positions of said actuator, permitting and breaking respectively said electrical path between said common strip section and said corresponding terminal.

9. A multiple pole single in-line package switch as recited in claim 8 wherein each said contact finger in a said switching cavity has an extension thereon at said free end thereof for engagement by said contact finger engaging means.

10. A multiple pole single in-line package switch as recited in claim 9 wherein said unitary contact means comprises an electrical conductive spring material, each said contact finger means has a planar elongated body section between said common strip and free end sections and each said free end section is bifurcated, the bifurcations each having a radiused depending portion forming a contact surface for engaging said terminal contact end section.

11. A multiple pole single in-line package switch as recited in claim 9 wherein each of said terminals lies in common plane, and each said actuator rotates about an axis parallel to the common plane and has a central body portion and axial end sections for riding in said seat means and supporting said body portion, said contact engaging means comprising a radial planar extension from said body portion between said axial end sections.

12. A multiple pole single in-line package switch as recited in claim 11 wherein said insulating housing includes an insulating base and insulating cover, said insulating base having each said seat portion formed therein with first and second detent recesses, each said actuator having an upper portion including said radial planar extension and a conjoined lower portion, said upper portion having first and second angled surfaces for defining first and second positions of the actuator with said cover means and said lower portion having a detent extension and for engaging said first and second detent recesses at positions corresponding to the first and second actuator positions.

13. A multiple pole single in-line package switch as recited in claim 8 wherein said insulating housing comprises an insulating base and cover, said insulating base having a platform coextensive with and transverse said first end sections of said cavities, and said cover has a depending beam coextensive with said platform, said beam and platform clamping said common strip section therebetween, said common strip section normally lying in a plane that is angularly displaced from a plane common to said contact fingers whereby said clamping action stresses said contact fingers and forces them into engagement with said terminal contact end sections.

14. A multiple pole single in-line package switch as recited in claim 13 wherein each said seat portion has first and second detent recesses, each said actuator having an upper portion including said radial planar extension and a conjoined lower portion, said upper portion having first and second angled surfaces for defining first and second positions of the actuator with said cover means and said lower portion having a detent extension and for engaging said first and second detent recesses at positions corresponding to the first and second actuator positions.

* * * * *